US005878767A

United States Patent [19]

Etling et al.

[11] Patent Number: 5,878,767

[45] Date of Patent: Mar. 9, 1999

[54] FLUID TRANSFER SYSTEM

[75] Inventors: Richard E. Etling, St. Louis; Samuel J. Jenkins, Kirkwood; Stephen J. Lorbert, St. Louis; Philip H. Allen, Ballwin; Anthony F. DeJohn, Chesterfield, all of Mo.

[73] Assignee: Novus International, Inc., St. Louis, Mo.

[21] Appl. No.: 764,968

[22] Filed: Dec. 13, 1996

[51] Int. Cl.[6] ..... B65B 31/00

[52] U.S. Cl. ..... 137/15; 131/240; 131/351; 131/565; 131/572; 141/59

[58] Field of Search ..... 137/351, 572, 137/240, 15, 565; 141/59

[56] References Cited

U.S. PATENT DOCUMENTS

| | | | |
|---|---|---|---|
| 2,549,674 | 4/1951 | Denham . | |
| 2,945,515 | 7/1960 | Zimmerman, Jr. . | |
| 3,780,757 | 12/1973 | Jordan . | |
| 3,840,056 | 10/1974 | Bower . | |
| 4,007,765 | 2/1977 | Bellows | 137/572 |
| 4,009,739 | 3/1977 | Weatherford . | |
| 4,058,148 | 11/1977 | Potter . | |
| 4,150,700 | 4/1979 | Fox, Jr. . | |
| 4,320,788 | 3/1982 | Lord . | |
| 4,497,334 | 2/1985 | Wolf et al. | 137/240 |
| 4,554,942 | 11/1985 | Williams et al. | 137/240 |
| 4,582,226 | 4/1986 | Doak | 137/240 |
| 4,735,225 | 4/1988 | Huveteau | 137/240 |
| 4,880,040 | 11/1989 | Pierson et al. . | |
| 5,069,244 | 12/1991 | Miyazaki et al. . | |
| 5,230,374 | 7/1993 | Dawson et al. . | |
| 5,377,715 | 1/1995 | Andenmatten et al. . | |
| 5,462,078 | 10/1995 | Andenmatten et al. . | |
| 5,511,580 | 4/1996 | Resseguier . | |
| 5,531,240 | 7/1996 | Kelada | 137/240 |

*Primary Examiner*—A. Michael Chambers
*Attorney, Agent, or Firm*—Senniger, Powers Leavitt & Roedel

[57] ABSTRACT

A system for transferring fluid from a filling reservoir to a receiving tank. The system includes a fluid transfer line for conveying fluid from the filling reservoir outlet to the receiving tank inlet, and couplings for selectively connecting the fluid transfer line to a filling reservoir outlet and a receiving tank inlet. The system further includes a vapor return line for conveying vapor from a receiving tank vent to a filling reservoir inlet to simultaneously prevent pressure from building in the tank and a vacuum from developing in the reservoir as fluid is transferred from the reservoir to the tank, and couplings for selectively connecting the vapor return line to the filling reservoir inlet and the receiving tank vent. In addition, the system includes a portable platform adapted for movement to a position near the filling reservoir and the receiving tank, and a pump mounted on the platform for selectively inducing fluid to travel through the fluid transfer line from the filling reservoir to the receiving tank when the reservoir outlet valve and the tank inlet valve are open. The system also includes a compressed gas source in communication with the fluid transfer line for blowing gas through the line to remove residual fluid from the line to prevent the escape of residual fluid and associated odor from the line when the fluid transfer line couplings are uncoupled from the filling reservoir outlet and the receiving tank inlet.

13 Claims, 1 Drawing Sheet

FLUID TRANSFER SYSTEM

BACKGROUND OF THE INVENTION

This invention relates generally to a method and apparatus for transferring fluid from a filling reservoir to a receiving tank. More particularly, the invention relates to a method and a portable apparatus for blowing gas, such as air, through one or more of the lines connecting the filling reservoir to the receiving tank to remove residual fluid from the lines before disconnecting them to prevent the release of odorous fluids.

Frequently, fluid materials must be transferred from a filling reservoir to a receiving tank either to fill the tank or to drain the reservoir. For instance, odorous chemicals are frequently transferred from a bulk storage reservoir to a rail car, then from the rail car to a tanker truck, and then from the truck to a local storage tank. Usually the chemicals are transferred by connecting a fluid transfer line from the outlet of the filling reservoir to the inlet of the receiving tank, and pumping the chemical through the transfer line from the filling reservoir to the receiving tank. During each transfer from one container to another, there is the opportunity to release some of the fluid, either as a liquid or as a gas. Even when fluid transfer from one container to another is successful, some residual fluid may escape when the transfer lines are disconnected from the containers. If the fluid is odorous, a release may be a nuisance.

Further, gas is typically vented from the receiving tank as it is filled thereby preventing pressure from building in the tank. If this gas vents to ambient, then vapor containing the transferred chemical may be released, causing a nuisance if the gas has an odor.

SUMMARY OF THE INVENTION

Among the several objects and features of the present invention may be noted the provision of a fluid transfer system which substantially eliminates release of fluid; the provision of such a system which prevents the escape of residual fluid and any odor from a transfer line when disconnected from the filling reservoir and the receiving tank; the provision of such a system which prevents pressure from building in the receiving tank; and the provision of such a system which prevents a vacuum from developing in the filling reservoir.

Briefly, apparatus of this invention is a system for transferring fluid from a filling reservoir to a receiving tank. Generally, the system comprises a fluid transfer line for conveying fluid from a filling reservoir outlet to a receiving tank inlet, and couplings for selectively connecting the fluid transfer line to the filling reservoir outlet and the receiving tank inlet. The system further comprises a vapor return line for conveying vapor from a receiving tank vent to a filling reservoir inlet to simultaneously prevent pressure from building in the tank and a vacuum from developing in the reservoir as fluid is transferred from the reservoir to the tank, and couplings for selectively connecting the vapor return line to the filling reservoir inlet and the receiving tank vent. In addition, the system comprises a portable platform adapted for movement to a position near the filling reservoir and the receiving tank, and a pump mounted on the platform for selectively inducing fluid to travel through the fluid transfer line from the filling reservoir to the receiving tank when the reservoir outlet valve and the tank inlet valve are open. The system also comprises a compressed gas source in communication with the fluid transfer line for blowing gas through the line to remove residual fluid from the line to prevent the escape of residual fluid and associated odor from the line when the fluid transfer line couplings are uncoupled from the filling reservoir outlet and the receiving tank inlet.

Another aspect of the invention includes a method for transferring fluid from a filling reservoir to a receiving tank. Generally, the method comprises the steps of connecting a fluid transfer line to the filling reservoir outlet and to the receiving tank inlet, and connecting a vapor return line to the filling reservoir inlet and to the receiving tank vent. The reservoir outlet valve and tank inlet valve are opened after the fluid transfer line and vapor return line are connected. Fluid is conveyed through the fluid transfer line from the filling reservoir to the receiving tank when the reservoir outlet and tank inlet valves are open. After transfer is complete, gas is blown through the fluid transfer line to remove residual fluid from the fluid transfer line. The reservoir outlet valve and the tank inlet valve are closed to prevent fluid flow through the filling reservoir outlet and the receiving tank inlet. The fluid transfer line and the vapor return line are disconnected from the filling reservoir and the receiving tank after residual fluid is blown out of the fluid transfer line and after the reservoir outlet and tank inlet valves are closed.

Other objects and features of the invention will be in part apparent and in part pointed out hereinafter.

DETAILED DESCRIPTION OF THE PREFERRED EMBODIMENT

Figure 1:
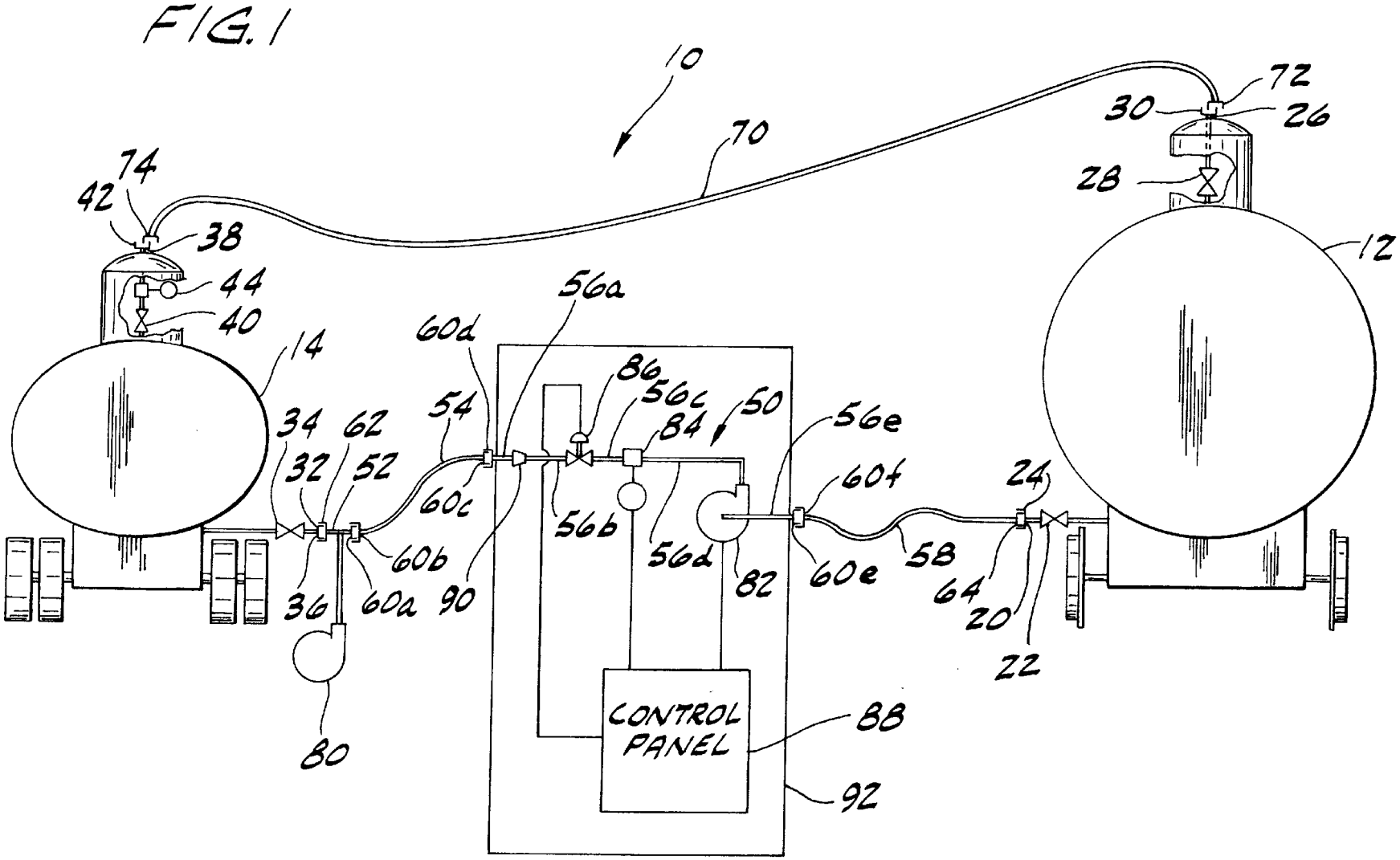
FIG. 1 is a schematic showing a fluid transfer system of the present invention.

Referring now to FIG. 1, a system of the present invention, generally designated 10, is used to transfer fluid from a filling reservoir 12 to a receiving tank 14. The filling reservoir 12 is shown as a railway tank car having a 20,000 gallon capacity, but it may be any one of several other types of reservoirs including a stationary storage tank. Likewise, the receiving tank 14 is shown as a semi truck tanker having a capacity of approximately 7000 gallons, but it may also be any one of several other types of tanks including a stationary storage tank.

The filling reservoir 12 has a three inch diameter outlet 20, preferably near the bottom of the reservoir, for discharging fluid from the reservoir. A manual outlet valve 22 positioned proximate the reservoir outlet 20 enables fluid flow through the outlet to be selectively interrupted. A coupling 24 such as a three inch diameter cam-lock style hose fitting is positioned adjacent the outlet valve 22 for connecting the reservoir outlet 20 to a standard fluid transfer line as will be explained below. The filling reservoir 12 also has a ¾ inch diameter inlet 26 to allow vapor to enter the reservoir to prevent a vacuum from developing in the reservoir when fluid is discharged through the outlet 20. An inlet valve 28 positioned proximate the reservoir inlet 26 enables fluid flow through the inlet to be selectively interrupted. As with the reservoir outlet 20, a coupling 30, such as a ¾ inch Chicago style quick disconnect hose fitting, is positioned adjacent the inlet valve 28 for connecting the inlet 26 to a second standard fluid transfer line.

Likewise, the receiving tank 14 has an inlet 32 for permitting fluid to enter the tank and an inlet valve 34 for selectively controlling fluid flow through the inlet of the receiving tank. The tank inlet 32 of the preferred embodiment has a three inch diameter. A three inch camlock style inlet coupling 36 is positioned adjacent the receiving tank inlet valve 34 to enable connection to a standard fluid transfer line. The receiving tank 14 also has a ¾ inch diameter vent 38 to allow vapor to escape from the tank to prevent pressure from building in the tank when fluid enters the tank through the inlet 32. A valve 40 is provided adjacent the vent 38 to selectively control fluid flow through the vent, and a ¾ inch Chicago style quick disconnect coupling 42 is positioned adjacent the valve 40 for connecting the vent to a standard fluid transfer line as will be explained below. A pressure gage 44 is also included near the vent 38 for measuring the pressure of vapor in the tank 14.

The system 10 comprises a fluid transfer line, generally designated 50, for conveying fluid from the outlet 20 of the filling reservoir 12 to the inlet 32 of the receiving tank 14. In the preferred embodiment, the fluid transfer line 50 includes a tee fitting 52, a first flexible hose 54, several lengths of rigid pipe 56*a*–56*e*, and a second flexible hose 58. These components are joined together by couplings 60*a*–60*f*. The first and second flexible hoses 54, 58, respectively, are conventional food grade liquid transfer hoses. Pipes 56*a*, 56*e* are three inch diameter 316L stainless steel pipes, and pipes 56*b*–56*d* are two inch diameter 316L stainless steel pipes. A three inch cam-lock style coupling 62 on the downstream end of the tee fitting 52 mates with the inlet coupling 36 of the receiving tank 14, and a three inch cam-lock style coupling 64 on the upstream end of the second flexible hose 58 mates with the outlet coupling 24 of the filling reservoir 12 to selectively connect the fluid transfer line 50 to the filling reservoir outlet 20 and the receiving tank inlet 32. The system 10 also comprises a one inch diameter vapor return line 70 for conveying vapor from the receiving tank vent 38 to the filling reservoir inlet 26 to simultaneously prevent pressure from building in the tank 14 and a vacuum from developing in the reservoir 12 as fluid is transferred from the reservoir to the tank. In addition, the vapor return line 70 captures vapor being released through the receiving tank vent 38 and directs it to the filling reservoir inlet 26. Thus, the system 10 is closed so odorous fluids may be transferred from one tank to another without releasing them to ambient and causing a nuisance. Couplings 72, 74 such as ¾ inch Chicago style quick disconnect hose fittings are provided on each end of the vapor return line 70 for selectively connecting the vapor return line 70 to the couplings 30, 42 provided at the filling reservoir inlet 26 and the receiving tank vent 38, respectively.

A compressed gas source such as an air compressor 80 is connected to the tee fitting 52 so it is in communication with the fluid transfer line 50 for blowing gas through the line to remove residual fluid from the line before the couplings along the fluid transfer line are uncoupled. Thus, when couplings 62, 64 are uncoupled from the filling reservoir outlet 20 or the receiving tank inlet 32, respectively, residual fluid and odor do not escape from the fluid transfer line 50. The air compressor 80 is positioned near the receiving tank inlet 32 in the preferred embodiment because the on-board air compressor from the tank trailer is used as the air compressor. In alternate embodiments (not shown), the compressed air source may be a pressurized air tank, a dedicated air compressor or any conventional means for delivering pressurized gas to the fluid transfer line 50.

A pump 82 is positioned between pipes 56*d* and 56*e* of the fluid transfer line 50 for selectively inducing fluid to travel through the fluid transfer line from the filling reservoir 12 to the receiving tank 14. Although other pumps are envisioned as being within the scope of the present invention, the pump 82 of the preferred embodiment is a ANSIMAG® K326-CA non-metallic magnetic drive centrifugal pump. ANSIMAG® is a U.S. federally registered trademark owned by Ansimag Inc. of Elk Grove Village, Ill. The pump is generally of a type which will prevent emissions during the transfer process. Preferably, the pump is of a type which does not require seal fluid.

A meter 84 positioned along the fluid transfer line 50 measures the amount of fluid conveyed through the fluid transfer line. The meter 84 of the preferred embodiment is a PROMAG 33D magnetic flowmeter. PROMAG is a trademark owned by Endress & Hauser, Inc. of Greenwood, Ind. A servo valve 86 provided along the fluid transfer line 50, downstream from the meter 84, selectively controls fluid flow through the fluid transfer line. Further, a control 88 is connected to the pump 82, the meter 84, and the valve 86 to control the pump and valve in response to a signal from the meter. The control 88 of the preferred embodiment includes a Batch Control II made by Kessler-Ellis Products of Atlantic Highlands, N.J. The control 88 includes a totalizer which adds the fluid flow signal from the meter 84 over time. When the sum of the fluid measured by the meter 84 exceeds a predetermined limit, the control 88 stops the pump 82 and closes the valve 86 to terminate fluid flow through the fluid transfer line 50. A conventional adaptor 90 connects the three inch pipe 56*a* to the two inch pipe 56*b* downstream from the valve 86 so the same diameter hoses 54, 58 may be used upstream and downstream from the pump 82.

The pump 82, meter 84, valve 86, control 88 and associated pipes 56*a*–56*e* are mounted on a platform or frame 92 which may be placed on a cart or vehicle so the system 10 can readily be moved to a position near the filling reservoir 12 and the receiving tank 14 for use. Alternatively, these components may be mounted in a stationary location without departing from the scope of the present invention.

Although a pump is used in the preferred embodiment to induce fluid to travel through the fluid transfer line 50, other means of inducing fluid travel are also envisioned as being within the scope of the present invention. For instance, gravity feed systems may be used to induce fluid travel without departing from the scope of the present invention.

Although specific dimensions, materials and components are identified above with respect to the preferred embodiment, it should be understood that other dimensions, materials and components may be used without departing from the scope of the invention defined by the claims.

To use the system 10 described above, the fluid transfer line couplings 64, 62 are connected to the filling reservoir outlet 20, and the receiving tank inlet 32, respectively. Likewise, the vapor return line couplings 72, 74 are connected to the filling reservoir inlet 26 and receiving tank vent 38, respectively. Once the fluid transfer line 50 and vapor return line 70 are connected to the respective tank orifices, the reservoir outlet valve 22 and tank inlet valve 34 are opened to permit liquid to travel from the filling reservoir 12 to the receiving tank 14. The reservoir inlet valve 28 and the tank vent valve 40 are also opened to permit fluid to travel through the vapor return line 70. Once all of the valves are opened, the pump 82 is activated to convey fluid through the fluid transfer line 50 from the filling reservoir 12 to the receiving tank 14.

The meter 84 measures the amount of fluid transferred from the filling reservoir 12 to the receiving tank 14 and sends a signal which is proportional to the measured amount to the control 88. The control 88 adds the signal over time. When the transferred amount equals some predetermined limit, such as the capacity of the receiving tank 14, the control 88 stops the pump 82 and closes the valve 86 to prevent the transfer of additional liquid from the reservoir 12 to the tank 14.

Prior to disconnecting the liquid transfer line 50 and the vapor return line 70, the air compressor 80 is energized by a truck (not shown) connected to the tank trailer to blow gas through the fluid transfer line 50 to remove residual fluid from the fluid transfer line. In the preferred method, the tank inlet valve 34 is closed prior to activating the air compressor to prevent fluid flow through the receiving tank inlet 32. Thus, gas is driven toward the filling reservoir 12 to blow the residual fluid into the filling reservoir. Once the fluid is removed from the fluid transfer line 50, the reservoir outlet valve 22 is closed to prevent fluid from re-entering the transfer line. The fluid transfer line 50 may then be disconnected from the filling reservoir 12 and the receiving tank 14 without releasing the residual fluid to ambient. Therefore, using the system 10 of the present invention, odorous fluid may be transferred without releasing vapor from the reservoir 12 and tank 14. Further, odorous fluid may be transferred using the system 10 without releasing residual fluid from the fluid transfer line 50 and causing a nuisance.

Alternatively, the tank inlet valve 34 may be left open while gas is blown through the fluid transfer line 50. If the tank inlet valve 34 is open during the blowing step, the reservoir outlet valve 22 may be open or closed. However, both valves should be closed prior to terminating the blowing operation to prevent fluid from re-entering the transfer line 50. If the tank inlet valve 34 is open and the reservoir outlet valve 22 is closed during the blowing step, it is desirable to connect the air compressor 80 to the fluid transfer line 50 adjacent the reservoir outlet valve so residual fluid is blown into the receiving tank 14.

In an alternate embodiment, gas may also be blown through the vapor return line 70 to remove residual fluid from the return line before it is disconnected from the filling reservoir 12 and the receiving tank 14. This is accomplished by connecting an air compressor to either end of the return line 70 and blowing gas through the line 70.

As used herein, the word "fluid" is meant to include any material in a liquid or gas state or in a partial liquid or gas state. The word "vapor" is meant to include any material in a gaseous state or a partial gaseous state, regardless of its temperature-pressure condition. The word "line" is meant to include any flexible or rigid tube capable of conveying a fluid. The word "near" is used in the context of the portable platform position to mean within a distance not exceeding the length of the longer of the fluid transfer line and vapor return line.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A method for transferring fluid from a filling reservoir to a receiving tank, the filling reservoir including an outlet for the discharge of fluid from the reservoir, an outlet valve for selectively controlling fluid flow through the outlet, and an inlet for permitting vapor to enter the reservoir to prevent a vacuum from developing in the reservoir when fluid is discharged from the reservoir through the outlet, the receiving tank including an inlet for permitting fluid to enter the tank, an inlet valve for selectively controlling fluid flow through the inlet of the receiving tank, and a vent for permitting vapor to escape from the tank to prevent pressure from building in the tank when fluid enters the tank through the inlet thereof, the method comprising the steps of:

connecting a fluid transfer line to the filling reservoir outlet and to the receiving tank inlet;

connecting a vapor return line to the filling reservoir inlet and to the receiving tank vent;

opening the reservoir outlet valve and tank inlet valve after the fluid transfer line and vapor return line are connected;

conveying fluid through the fluid transfer line from the filling reservoir to the receiving tank when the reservoir outlet and tank inlet valves are open;

blowing gas through the fluid transfer line to remove residual fluid from the fluid transfer line;

closing the reservoir outlet valve and the tank inlet valve to prevent fluid flow through the filling reservoir outlet and the receiving tank inlet; and disconnecting the fluid transfer line and the vapor return line from the filling reservoir and the receiving tank after residual fluid is blown out of the fluid transfer line and after the reservoir outlet and tank inlet valves are closed.

2. A method as set forth in claim 1 wherein the step of closing the reservoir outlet valve and the tank inlet valve is performed before terminating the step of blowing gas through the fluid transfer line.

3. A method as set forth in claim 2 wherein the step of closing the tank inlet valve to prevent fluid flow through the receiving tank inlet is performed before the step of blowing gas through the fluid transfer line to remove residual fluid from the fluid transfer line.

4. A method as set forth in claim 1 further comprising the steps of:

measuring an amount of fluid conveyed through the fluid transfer line; and stopping fluid flow through the fluid transfer line when the amount of fluid measured by the meter exceeds a predetermined limit.

5. A method as set forth in claim 1 wherein the step of conveying fluid through the fluid transfer line includes the step of pumping fluid through the fluid transfer line from the filling reservoir to the receiving tank when the reservoir outlet valve and the tank inlet valve are open.

6. A method as set forth in claim 5 wherein the pumping step is stopped prior to beginning the blowing step.

7. A system for transferring fluid from a filling reservoir to a receiving tank, the filling reservoir including an outlet for the discharge of fluid from the reservoir, an outlet valve for selectively controlling fluid flow through the outlet, and an inlet for permitting vapor to enter the reservoir to prevent a vacuum from developing in the reservoir when fluid is discharged from the reservoir through the outlet, the receiving tank including an inlet for permitting fluid to enter the tank, an inlet valve for selectively controlling fluid flow through the inlet of the receiving tank, and a vent for permitting vapor to escape from the tank to prevent pressure from building in the tank when fluid enters the tank through the inlet thereof, the system comprising:

a fluid transfer line for conveying fluid from the outlet of the filling reservoir to the inlet of the receiving tank, and couplings for selectively connecting the fluid transfer line to the filling reservoir outlet and the receiving tank inlet;

a vapor return line for conveying vapor from the vent of the receiving tank to the inlet of the filling reservoir to simultaneously prevent pressure from building in the tank and a vacuum from developing in the reservoir as fluid is transferred from the reservoir to the tank, and couplings for selectively connecting the vapor return line to the filling reservoir inlet and the receiving tank vent;

a portable platform adapted for movement to a position near the filling reservoir and the receiving tank;

a pump mounted on the platform for selectively inducing fluid to travel through the fluid transfer line from the filling reservoir to the receiving tank when the reservoir outlet valve and the tank inlet valve are open; and a compressed gas source in communication with the fluid transfer line for blowing gas through the line to remove residual fluid from the line thereby to prevent the escape of residual fluid and associated odor from the line when the fluid transfer line couplings are uncoupled from the filling reservoir and the receiving tank.

8. A system as set forth in claim 7 wherein the compressed gas source comprises an air compressor.

9. A system as set forth in claim 7 wherein the compressed gas source is positioned proximate the receiving tank inlet and is operable to blow gas through the fluid transfer line when the receiving tank inlet valve is closed and the filling reservoir outlet valve is open whereby residual fluid in the fluid transfer line is blown into the filling reservoir thereby to prevent the escape of residual fluid and any odor from the fluid transfer line when the fluid transfer line couplings are uncoupled from the filling reservoir and the receiving tank.

10. A system as set forth in claim 7 further comprising a control mounted on the platform for controlling operation of the pump.

11. A system as set forth in claim 7 further comprising a meter in communication with the fluid transfer line for measuring an amount of fluid conveyed through the fluid transfer line.

12. A system as set forth in claim 11 wherein the meter generates a signal representing the amount of fluid conveyed through the fluid transfer line, and the system further comprises a control mounted on the platform for controlling operation of the pump, the control being responsive to the signal from the meter to stop the pump from inducing fluid flow through the fluid transfer line when an amount of fluid transferred through the fluid transfer line exceeds a predetermined limit.

13. A system as set forth in claim 12 further comprising a valve positioned in the fluid transfer line for selectively controlling fluid flow through the fluid transfer line, the fluid transfer line valve being closed by the control in response to the signal from the meter to terminate fluid flow through the fluid transfer line.

* * * * *